US007104823B2

(12) United States Patent
Jazowski et al.

(10) Patent No.: US 7,104,823 B2
(45) Date of Patent: Sep. 12, 2006

(54) ENHANCED SEPARABLE CONNECTOR WITH THERMOPLASTIC MEMBER AND RELATED METHODS

(75) Inventors: Roy E. Jazowski, Ormond Beach, FL (US); Paul W. Lubinsky, deceased, late of Palm Coast, FL (US); by Marie T. Lubinsky, legal representative, Palm Coast, FL (US)

(73) Assignee: Homac Mfg. Company, Ormond Beach, FL (US)

( * ) Notice: Subject to any disclaimer, the term of this patent is extended or adjusted under 35 U.S.C. 154(b) by 0 days.

(21) Appl. No.: 11/198,948

(22) Filed: Aug. 8, 2005

(65) Prior Publication Data

US 2006/0035498 A1 Feb. 16, 2006

Related U.S. Application Data

(63) Continuation-in-part of application No. 11/140,325, filed on May 27, 2005, which is a continuation-in-part of application No. 10/438,750, filed on May 15, 2003, now Pat. No. 6,905,356.

(60) Provisional application No. 60/600,566, filed on Aug. 11, 2004, provisional application No. 60/380,914, filed on May 16, 2002.

(51) Int. Cl.
*H01R 13/53* (2006.01)

(52) U.S. Cl. ..... 439/181; 439/606; 439/921

(58) Field of Classification Search ..... 439/181–187, 439/606, 88, 921; 218/1
See application file for complete search history.

(56) References Cited

U.S. PATENT DOCUMENTS 3,306,879 A 2/1967 Pattison ..... 260/77.5
3,343,153 A 9/1967 Waehner
3,390,331 A 6/1968 Brown et al.
3,515,798 A 6/1970 Sievert ..... 174/135
3,576,493 A 4/1971 Tachick et al. ..... 324/133
3,723,270 A 3/1973 Tabata et al. ..... 204/159
3,735,025 A 5/1973 Ling et al. ..... 174/120
3,736,505 A 5/1973 Sankey ..... 324/133
3,880,557 A 4/1975 Nelson ..... 425/108
3,933,773 A 1/1976 Foerster ..... 260/87.5
3,951,871 A 4/1976 Lloyd et al. ..... 252/511

(Continued)

OTHER PUBLICATIONS

The Technical Service Magazine for the Rubber Industry, vol. 227, No. 3 on "Overmolding of TPEs Molding TSEs and TPEs, Solid $CO_2$ Pellet Blasting of Molds", Dec. 2002, features 24, 27 and 33.

(Continued)

*Primary Examiner*—Michael C. Zarroli
(74) *Attorney, Agent, or Firm*—Allen, Dyer, Doppelt, Milbrath & Gilchrist, P.A.

(57) ABSTRACT

A connector body may have a passageway therethrough and may include a first layer adjacent the passageway and having a relatively low resistivity, a second layer surrounding the first layer and including a material having a relatively high resistivity, and a third layer surrounding the second layer and including a material having the relatively low resistivity. At least one of the first, second and third layers may include a thermoplastic elastomer (TPE) material. The connector body may also include at least one member of a different thermoplastic material than the TPE material and being bonded to adjacent portions of the TPE material. For example, the different thermoplastic material may comprise polypropylene and the member may be a pulling eye or test point insert. In other embodiments, instead of TPE, at least one of the first, second and third layers may include a silicone material.

40 Claims, 13 Drawing Sheets

U.S. PATENT DOCUMENTS

| | | | | |
|---|---|---|---|---|
| 3,992,567 | A | 11/1976 | Malia | 174/73 |
| 4,032,214 | A * | 6/1977 | McNerney | 439/606 |
| 4,053,702 | A | 10/1977 | Erickson et al. | 174/73 |
| 4,175,815 | A | 11/1979 | Andersen et al. | 439/89 |
| 4,210,381 | A | 7/1980 | Borgstrom | 439/161 |
| 4,222,625 | A | 9/1980 | Reed | 339/143 |
| 4,363,842 | A | 12/1982 | Nelson | 428/36 |
| 4,383,131 | A | 5/1983 | Clabburn | 174/73 |
| 4,629,277 | A | 12/1986 | Boettcher et al. | 339/111 |
| 4,675,475 | A | 6/1987 | Bortner et al. | 174/113 |
| 4,738,318 | A | 4/1988 | Boettcher et al. | 174/73 |
| 4,758,171 | A | 7/1988 | Hey | 439/181 |
| 4,847,450 | A | 7/1989 | Rupprecht | 174/143 |
| 4,863,392 | A | 9/1989 | Borgstrom et al. | 439/185 |
| 4,904,932 | A | 2/1990 | Schweitzer, Jr. | 324/133 |
| 4,946,393 | A | 8/1990 | Borgstrom et al. | 439/88 |
| 5,080,942 | A | 1/1992 | Yau | 428/349 |
| 5,088,001 | A | 2/1992 | Yaworski et al. | 361/127 |
| 5,215,475 | A | 6/1993 | Stevens | 439/206 |
| 5,226,837 | A | 7/1993 | Ciniulk et al. | 439/521 |
| 5,230,640 | A | 7/1993 | Tardif | 439/578 |
| 5,421,750 | A | 6/1995 | Crotty | 439/801 |
| 5,433,622 | A | 7/1995 | Galambos | 439/282 |
| 5,445,533 | A | 8/1995 | Roscizewski et al. | 439/184 |
| 5,486,388 | A | 1/1996 | Portas et al. | 428/34.9 |
| 5,492,740 | A | 2/1996 | Vallauri et al. | 428/34.9 |
| 5,573,410 | A | 11/1996 | Stepniak | 439/88 |
| 5,641,306 | A | 6/1997 | Stepniak | 439/491 |
| 5,795,180 | A | 8/1998 | Siebens | 439/489 |
| 5,801,332 | A | 9/1998 | Berger et al. | 174/73.1 |
| 5,804,630 | A | 9/1998 | Heyer et al. | 524/436 |
| 5,844,170 | A | 12/1998 | Chor et al. | 174/74 |
| 5,846,093 | A | 12/1998 | Muench, Jr. et al. | 439/89 |
| 5,857,862 | A | 1/1999 | Muench et al. | 439/181 |
| 5,957,712 | A | 9/1999 | Stepniak | 439/187 |
| 6,015,629 | A | 1/2000 | Heyer et al. | 428/625 |
| 6,040,366 | A | 3/2000 | Burkus, II et al. | 524/99 |
| 6,106,954 | A | 8/2000 | Meguriya et al. | 428/447 |
| 6,124,549 | A | 9/2000 | Kemp et al. | 174/73.1 |
| 6,168,447 | B1 | 1/2001 | Stepniak et al. | 439/187 |
| 6,213,799 | B1 | 4/2001 | Jazowski et al. | 439/181 |
| 6,231,404 | B1 * | 5/2001 | Lichy | 439/811 |
| 6,338,637 | B1 | 1/2002 | Muench, Jr. et al. | 439/201 |
| 6,340,794 | B1 | 1/2002 | Wandmacher et al. | 174/73.1 |
| 6,573,303 | B1 | 6/2003 | Liu et al. | 521/41 |
| 6,678,139 | B1 | 1/2004 | Greuter et al. | 361/117 |
| 6,688,921 | B1 | 2/2004 | Borgstrom et al. | 439/798 |
| 6,811,418 | B1 | 11/2004 | Jazowski et al. | 439/181 |
| 2002/0055290 | A1 | 5/2002 | Jazowski et al. | 439/187 |
| 2002/0055567 | A1 | 5/2002 | Romenesko et al. | 524/261 |
| 2004/0102091 | A1 | 5/2004 | Jazowski et al. | 439/606 |

OTHER PUBLICATIONS

Advanced Elastomer Systems, Trends in Plastics, © Plastics Trends 2000-2002, "It Seals, Feels, Flexes, and is called Thermoplastic Elastomer", May 2000.

Ensto Connector OY, Finland published by The Website for the Airport Industry on "Ensto Connector OY—AGL Series Transformers, Primary and Secondary Connectors and Cable Assemblies for Airfield Lighting Markets", pp. 1-3, Jul. 17, 2002.

3M "QS-III 5415A, 5416A,5417A, 5417A-WG,5418A and 5418A-WG 15 kV Cold Shrink Inline Splice Kits"—Data Sheet, pp. 1-6, 2002.

Dow Corning Superior High Voltage Insulators Start with Dow Corning® HV Silicone Rubber, pp. 1-6, 1998, 2000.

* cited by examiner

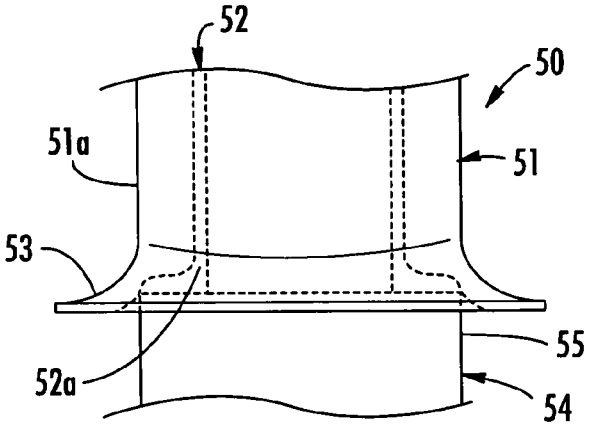
FIG.7
FIG.8
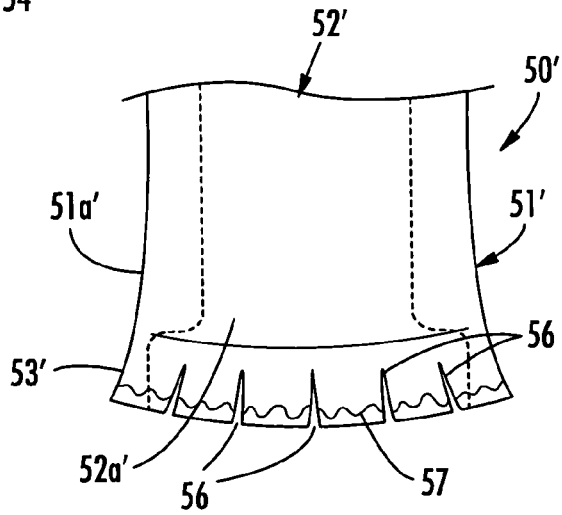
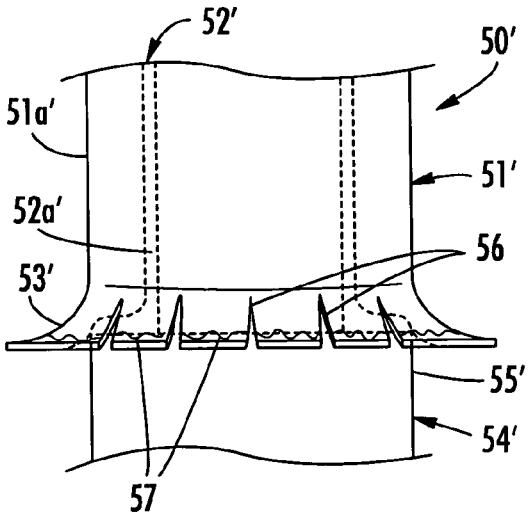
FIG.9
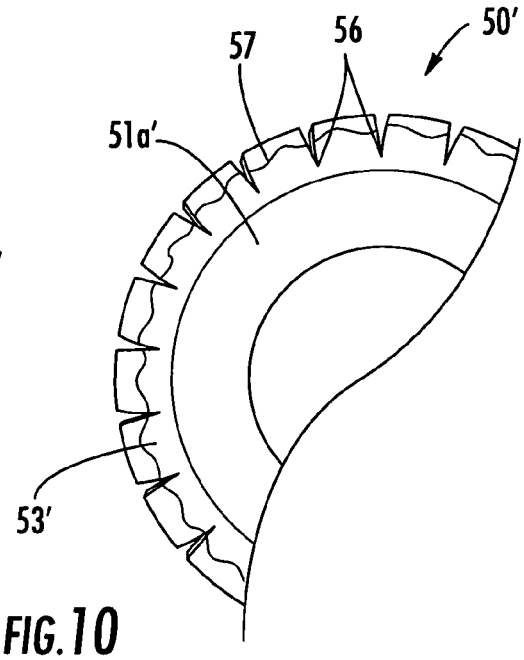
FIG.10

ENHANCED SEPARABLE CONNECTOR WITH THERMOPLASTIC MEMBER AND RELATED METHODS

RELATED APPLICATIONS

The present application is based upon prior filed copending provisional application Ser. No. 60/600,566 filed Aug. 11, 2004, and is also a continuation-in-part of U.S. patent application Ser. No. 11/140,325 filed May 27, 2005, that, in turn, is a continuation-in-part of U.S. patent application Ser. No. 10/438,750 filed May 15, 2003 now U.S. Pat. No. 6,905,356, that, in turn, is based upon prior filed provisional application Ser. No. 60/380,914 filed May 16, 2002. The entire contents of each application is incorporated herein by reference.

FIELD OF THE INVENTION

The present invention relates to electrical products, and more particularly, to electrical connectors for electrical systems and associated methods.

BACKGROUND OF THE INVENTION

An electrical distribution system typically includes distribution lines or feeders that extend out from a substation transformer. The substation transformer is typically connected to a generator via electrical transmission lines.

Along the path of a feeder, one or more distribution transformers may be provided to further step down the distribution voltage for a commercial or residential customer. The distribution voltage range may be from 5 through 46 kV, for example. Various connectors are used throughout the distribution system. In particular, the primary side of a distribution transformer typically includes a transformer bushing to which a bushing insert is connected. In turn, an elbow connector may be removably coupled to the bushing insert. The distribution feeder is also fixed to the other end of the elbow connector. Of course, other types of connectors are also used in a typical electrical power distribution system. For example, the connectors may be considered as including other types of removable or separable connectors, as well as fixed splices and terminations. Large commercial users may also have a need for such high voltage connectors.

One particular difficulty with conventional elbow connectors, for example, is that they use curable materials. For example, such a connector may typically be manufactured by molding the inner semiconductive layer first, then the outer semiconductive jacket (or vise-versa). These two components are placed in a final insulation press and then insulation layer is injected between these two semiconductive layers. Accordingly, the manufacturing time is relatively long, as the materials need to be allowed to cure during manufacturing. In addition, the conventional EPDM materials used for such elbow connectors and their associated bushing inserts, may have other shortcomings as well.

One typically desired feature of an elbow connector is the ability to readily determine if the circuit in which the connector is coupled is energized. Accordingly, voltage test points have been provided on such connectors. For example, U.S. Pat. No. 3,390,331 to Brown et al. discloses an elbow connector including an electrically conductive electrode embedded in the insulator in spaced relation from the interior conductor. The test point will rise to a voltage if the connector is energized. U.S. Pat. No. 3,736,505 to Sankey; U.S. Pat. No. 3,576,493 to Tachick et al.; U.S. Pat. No. 4,904,932 to Schweitzer, Jr.; and U.S. Pat. No. 4,946,393 to Borgstrom et al. disclose similar test points for an elbow connector. Such voltage test points may be somewhat difficult to fabricate, and upon contamination and repeated use, they may become less accurate and less reliable.

An elbow connector typically includes a connector body having a passageway with a bend therein. A semiconductive EPDM material defines an inner layer at the bend in the passageway. An insulative EPDM second layer surrounds the first layer, and a third semiconductive EPDM layer or outer shield surrounds the second insulative layer. A first end of the passageway is enlarged and carries an electrode or probe that is matingly received in the bushing insert. A second end of the passageway receives the end of the electrical conductor. The second connector end desirably seals tightly against the electrical conductor or feeder end. Accordingly, another potential shortcoming of such an elbow connector is the difficulty in manually pushing the electrical conductor into the second end of the connector body.

In an attempt to address the difficulty of inserting the electrical connector into the second connector end, U.S. Pat. No. 4,629,277 to Boettcher et al. discloses an elbow connector including heat shrinkable tubing integral with an end for receiving an electrical conductor. Accordingly, the conductor end can be easily inserted into the expanded tube, and the tube heated to shrink and seal tightly against the conductor. U.S. Pat. No. 4,758,171 to Hey applies a heat shrink tube to the cable end prior to push-fitting the cable end into the body of the elbow connector.

U.S. Pat. No. 5,230,640 to Tardif discloses an elbow connector including a cold shrink core positioned in the end of an elbow connector comprising EPDM to permit the cable to be installed and thereafter sealed to the connector body when the core is removed. However, this connector may suffer from the noted drawbacks in terms of manufacturing speed and cost. U.S. Pat. No. 5,486,388 to Portas et al.; U.S. Pat. No. 5,492,740 to Vallauri et al.; U.S. Pat. No. 5,801,332 to Berger et al.; and U.S. Pat. No. 5,844,170 to Chor et al. each discloses a similar cold shrink tube for a tubular electrical splice.

Another issue that may arise for an elbow connector is electrical stress that may damage the first or semiconductive layer. A number of patents disclose selecting geometries and/or material properties for an electrical connector to reduce electrical stress, such as U.S. Pat. No. 3,992,567 to Malia; U.S. Pat. No. 4,053,702 to Erikson et al.; U.S. Pat. No. 4,383,131 to Clabburn U.S. Pat. No. 4,738,318 to Boettcher et al.; U.S. Pat. No. 4,847,450 to Rupprecht, deceased; U.S. Pat. No. 5,804,630 and U.S. Pat. No. 6,015,629 to Heyer et al.; U.S. Pat. No. 6,124,549 to Kemp et al.; and U.S. Pat. No. 6,340,794 to Wandmacher et al.

For a typical 200 Amp elbow connector, the elbow cuff or outer first end is designed to go over the shoulder of the mating bushing insert and is used for containment of the arc and/or gasses produced during a load-make or load-break operation. During the past few years, the industry has identified the cause of a flashover problem which has been reoccurring at 25 kV and 35 kV. The industry has found that a partial vacuum occurs at certain temperatures and circuit conditions. This partial vacuum decreases the dielectric strength of air and the interfaces flashover when the elbow is removed from the bushing insert. Various manufacturers have attempted to address this problem by venting the elbow cuff interface area, and at least one other manufacturer has insulated all of the conductive members inside the interfaces.

U.S. Pat. No. 6,213,799 and its continuation Application No. 2002/00055290 A1 to Jazowski et al., for example, each discloses an anti-flashover ring carried by the bushing insert for a removable elbow connector. The ring includes a series of passageways thereon to prevent the partial vacuum from forming during removal of the elbow connector that could otherwise cause flashover. U.S. Pat. No. 5,957,712 to Stepniak and U.S. Pat. No. 6,168,447 to Stepniak et al. also each discloses a modification to the bushing insert to include passageways to reduce flashover. Another approach to address flashover is disclosed in U.S. Pat. No. 5,846,093 to Muench, Jr. et al. that provides a rigid member in the elbow connector so that it does not stretch upon removal from the bushing insert thereby creating a partial vacuum. U.S. Pat. No. 5,857,862 to Muench, Jr. et al. discloses an elbow connector including an insert that contains an additional volume of air to address the partial vacuum creation and resulting flashover.

Yet another potential shortcoming of a conventional elbow connector, for example, is being able to visually determine whether the connector is properly seated onto the bushing insert. U.S. Pat. No. 6,213,799 and its continuation Application No. 2002/00055290 A1 to Jazowski et al., mentioned above, each discloses that the anti-flashover ring on the bushing insert is colored and serves as a visual indicator that the elbow connector is seated when the ring is obscured.

U.S. Pat. No. 5,641,306 to Stepniak discloses a separable load-break elbow connector with a series of colored bands that are obscured when received within a mating connector part to indicate proper installation. Along these lines, but relating to the electrical bushing insert, U.S. Pat. No. 5,795,180 to Siebens discloses a separable load break connector and mating electrical bushing wherein the busing includes a colored band that is obscured when the elbow connector is mated to a bushing that surrounds the removable connector.

Conventional separable connectors, such as elbow connectors, may use one or more members, such as metallic inserts, for the test point and/or pulling eye. For example, the metal may typically be aluminum for the test point, and stainless steel for the pulling eye. For the bushing separable connector, a metal container may be positioned within the connector body. Such metal components typically require fairly aggressive adhesives to achieve a satisfactory bond with adjacent portions, and these adhesives may be considered environmentally unfriendly.

SUMMARY OF THE INVENTION

In view of the foregoing background, it is therefore an object of the present invention to provide an electrical connector and associated method where portions of the connector may be joined without the use of environmentally unfriendly adhesives.

These and other objects features and advantages in accordance with the present invention are provided by an electrical connector comprising a connector body having a passageway therethrough and including a first layer adjacent the passageway and having a relatively low resistivity, a second layer surrounding the first layer and comprising a material having a relatively high resistivity, and a third layer surrounding the second layer and comprising a material having the relatively low resistivity. Moreover at least one of the first, second and third layers may comprise a thermoplastic elastomer (TPE) material, and the connector may also include at least one member comprising a different thermoplastic material than the TPE material and being bonded to adjacent portions of the TPE material. For example, the different thermoplastic material may comprise polypropylene.

The different thermoplastic may form a strong bond to the TPE and may be useful when at least the third layer comprises the TPE material, and the at least one member comprises a pulling eye insert embedded in the third layer. In another example, the at least one member may comprise a test point insert embedded in the third layer.

As yet another example, at least the first layer may comprise the TPE material, and the member may comprise a tubular thermoplastic layer within the first layer. In this example, the connector may further include a tubular metal layer within the tubular thermoplastic layer and bonded thereto. In other words, in this connector embodiment the tubular thermoplastic layer serves to bond the tubular metal layer to the surrounding first layer of the connector body.

The passageway of the electrical connector may have first and second ends and a medial portion extending therebetween. The first layer may be positioned along the medial portion of the passageway and may be spaced inwardly from respective ends thereof. In some connector embodiments, the medial portion of the passageway may have a bend therein. In other embodiments, the connector body may have a tubular shape defining the passageway.

The connector body may be configured for at least one of 15 KV and 200 Amp operation. In addition, each of the first and third layers may have a resistivity less than about $10^8$ Ω·cm; and the second layer may have a resistivity greater than about $10^8$ Ω·cm.

The invention is also applicable to an electrical connector wherein, instead of TPE, at least one of the first, second and third layers comprises a silicone material. In these connector embodiments, the at least one member may comprise a thermoplastic material bonded to adjacent silicone material portions. The thermoplastic material may comprise nylon, for example.

Another aspect of the invention relates to a method for making the TPE material connector. The method may include forming at least one of the first, second and third layers to comprise a thermoplastic elastomer (TPE) material, and bonding at least one member comprising a different thermoplastic material than the TPE material to adjacent portions of the TPE material. Another method aspect is for making the silicone material connector and may include forming at least one of the first, second and third layers to comprise a silicone material, and bonding at least one member comprising a thermoplastic material to adjacent portions of the silicone material.

BRIEF DESCRIPTION OF THE DRAWINGS

FIG. 7 is a schematic side elevational view of a first end portion of an elbow connector mated onto an electrical bushing insert in accordance with the invention.

FIG. 8 is a schematic side elevational view of a first end portion of another embodiment of the elbow connector prior to mating with an electrical bushing insert in accordance with the invention.

FIG. 9 is a schematic side elevational view of the elbow connector shown in FIG. 8 after mating with the electrical bushing insert.

FIG. 10 is a schematic top plan view of a portion of the elbow connector as shown in FIG. 9.

DETAILED DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime and multiple prime notation are used in alternative embodiments to indicate similar elements.

Figure 1:
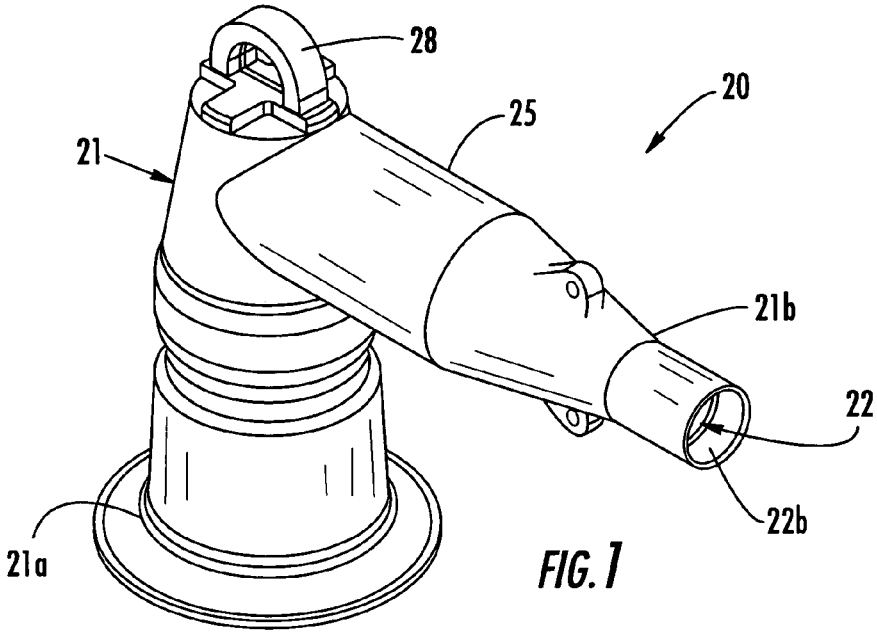
FIG. 1 is a perspective view of an elbow connector in accordance with the invention.
Figure 2:
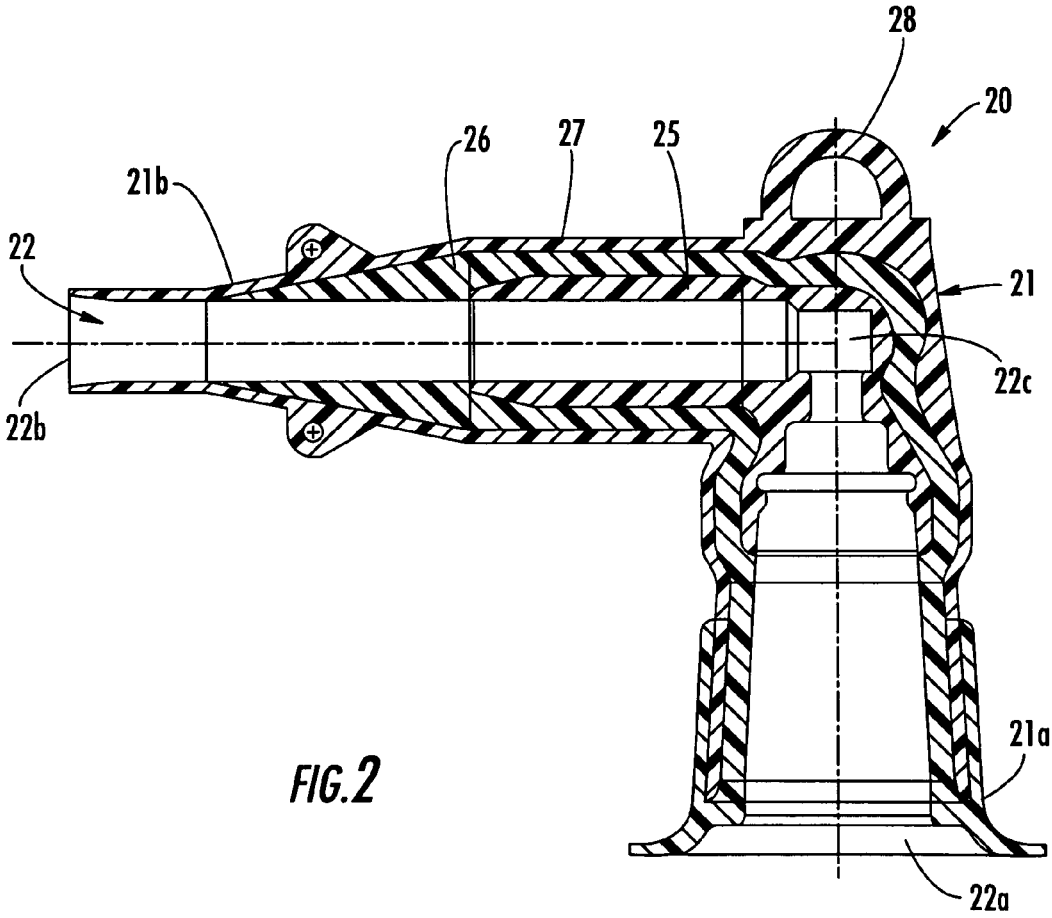
FIG. 2 is a longitudinal cross-sectional view of the elbow connector shown in FIG. 1.

Referring initially to FIGS. 1 and 2, an electrical elbow connector 20 is initially described. As will be appreciated by those skilled in the art, the elbow connector 20 is but one example of an electrical connector, such as for high voltage power distribution applications, comprising a connector body having a passageway 22 therethrough. The passageway 22 illustratively includes a first end 22*a*, a second end 22*b*, and a medial portion 22*c* having a bend therein. For clarity of explanation, the connector body 21 of the connector 20 is shown without the associated electrically conductive hardware, including the electrode or probe that would be positioned within the enlarged first end 22*a* of the passageway 22, as would be readily understood by those skilled in the art.

The connector body 21 includes a first layer 25 adjacent the passageway 22, a second layer 26 surrounding the first layer, and a third layer 27 surrounding the second layer. At least the second layer may comprise an insulative thermoplastic elastomer (TPE) material. The first and third layers 25, 27 also preferably have a relatively low resistivity. In some embodiments, the third layer 27 may comprise a semiconductive TPE material. In addition, the first layer 25 may also comprise a semiconductive TPE material. In other embodiments, the first layer 25 may comprise another material, such as a conventional EPDM rubber.

By using relatively new electrical grade TPE materials, such as thermoplastic olefin materials, thermoplastic polyolefin materials, thermoplastic vulcanites, and/or thermoplastic silicone materials, etc., molding can use new layer technology. This technology may include molding the first or inner semiconductive layer 25 first, then overmolding the second or insulation layer 26, and then overmolding the third or outer semiconductive shield layer 27 over the insulation layer. Some of the suppliers for such materials are: A. Schulman—Akron, Ohio; AlphaGary Corp.—Leominster, Mass.; Equistar Chemicals—Houston, Tex.; M.A. Industries, Inc.—Peachtree City, Ga.; Montrell North America—Wilmington, Del.; Network Polymers, Inc.—Akron, Ohio Solutia, Inc.—St. Louis, Mo.; Solvay Engineering Polymers—Auburn Hills, Mich.; Teknor Aprex International—Pawtucket, R.I.; Vi-Chem Corp.—Grand Rapids, Mich.; and Dow Chemicals—Somerset, N.J. In other words, the TPE material layers may be overmolded to thereby increase production speed and efficiency thereby lowering production costs. The TPE material may also provide excellent electrical performance.

The use of a TPE material for the third layer 27 permits the entire outer portion of the connector 20 to be color coded, such as by the addition of colorants to the TPE material as will be appreciated by those skilled in the art. For example, a proposed industry standard specifies red for 15 KV connectors, and blue for 25 KV connectors. Gray is another color that TPE materials may exhibit for color coding. Of course, other colors may also be used.

In the illustrated connector 20 embodiment, a first connector end 21*a* adjacent the first end 22*a* of the passageway 22 has a progressively increasing outer diameter. The second connector end 21*b* adjacent the second end 22*b* of the passageway 22 has a progressively decreasing outer diameter. As will be appreciated by those skilled in the art, other configurations of connectors ends 21*a*, 21*b* are also possible.

As illustrated, the first layer 25 defines an innermost layer, and the third layer 27 defines the outermost layer. The connector 20 also illustratively includes a pulling eye 28 carried by the connector body 21.

The connector body 21 may be configured for at least 15 KV and 200 Amp operation, although other operating parameters will be appreciated by those skilled in the art. In addition, each of the first and third layers 25, 27 may have a resistivity less than about $10^8$ Ω·cm, and the second layer 26 may have a resistivity greater than about $10^8$ Ω·cm. Accordingly, the term semiconductive, as used herein, is also meant to include materials with resistivities so low, they could also be considered conductors.

Those of skill in the art will appreciate that although an elbow connector 20 is shown and described above, the features and advantages can also be incorporated into T-shaped connectors that are included within the class of removable connectors having a bend therein. This concept of overlay technology may also be used for molding a generation of insulated separable connectors, splices and terminations that may be used in the underground electrical distribution market, for example. Some of these other types of electrical connectors are described in greater detail below.

Figure 3:
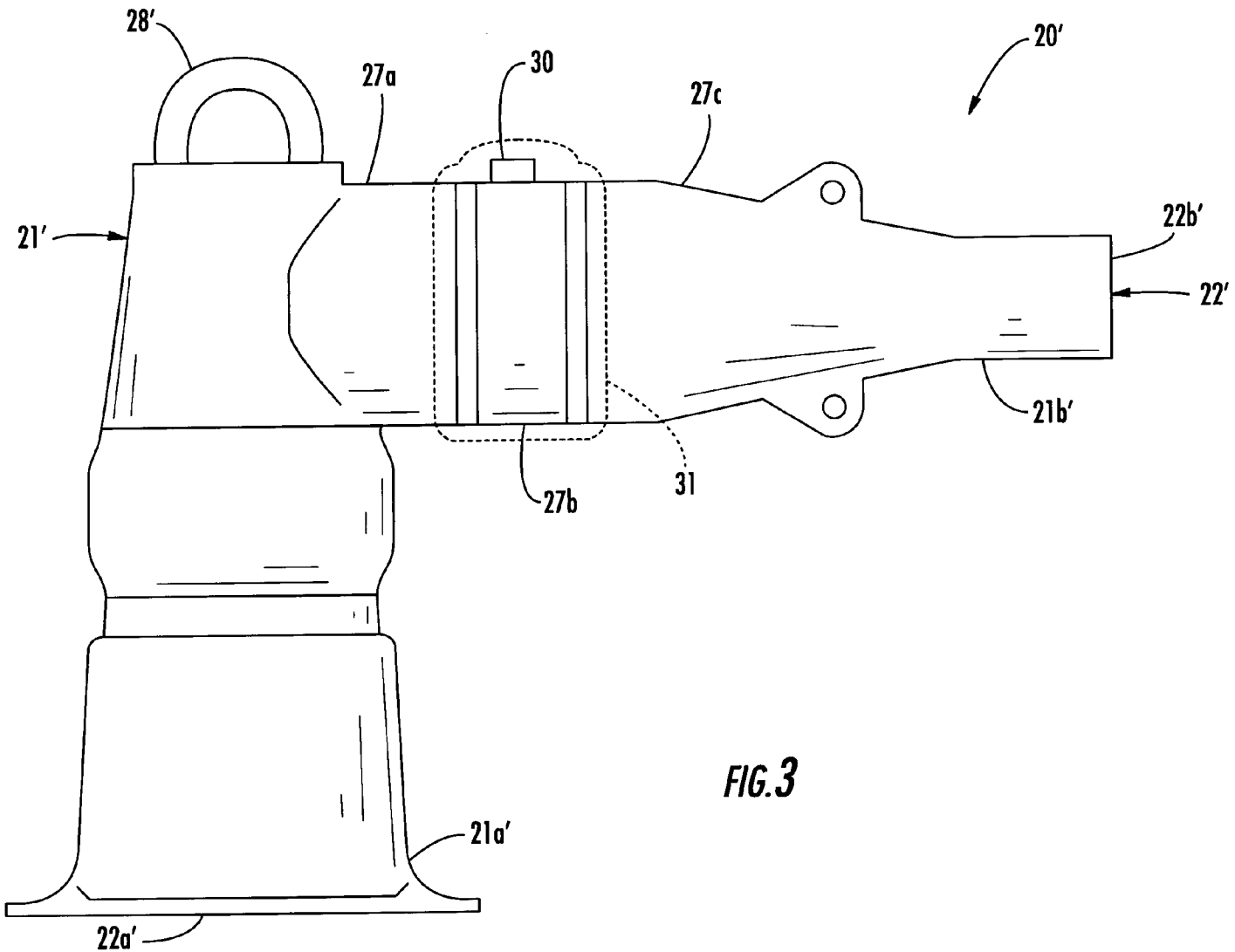
FIG. 3 is a side elevational view of an elbow connector including a split shield voltage test point in accordance with the invention.

Referring now additionally to FIG. 3, another aspect of an electrical elbow connector 20' is now described. Presently, an approach for providing a feedback voltage of a connector is derived from an elbow test point as described in the above background of the invention. As also described, sometimes such a test point can be unreliable if contaminated or wet, and the voltage can be easily saturated. The connector 20' of the invention illustratively includes a split shield 27'. In other words, the third layer 27' is arranged in three spaced apart portions with first and third portions 27*a*, 27*c* to be connected to a reference voltage so that the second portion 27*b* floats at a monitor voltage for the electrical connector 20'. In the illustrated embodiment, the second portion 27*b* of the third layer 27' has a band shape surrounding the passageway 22'. Those other elements of the connector 20' are indicated with prime notation and are similar to those elements described above with reference to FIGS. 1 and 2.

A monitor point 30 is illustratively connected to the second portion 27*b* of the third layer 27'. In addition, a cover 31 may be provided to electrically connect the first and third portions 27*a*, 27*c* of the third layer 27' yet permit access to the monitor point 30 as will be appreciated by those skilled in the art. For example, the cover 31 may have a hinged lid, not shown, to permit access to the monitor point 30, although other configurations are also contemplated.

By splitting or separating adjacent portions of the third layer 27' or outer conductive shield, a reliable voltage source can be provided that can be used to monitor equipment problems, detect energized or non-energized circuits, and/or used by fault monitoring equipment, etc. as will be appreciated by those skilled in the art. By splitting and isolating the shield at various lengths and sizes, different voltages can provide feedback to monitoring equipment. The TPE materials facilitate this split shield feature, and this feature can be used on many types of electrical connectors in addition to the illustrated elbow connector 20'.

Figure 4:
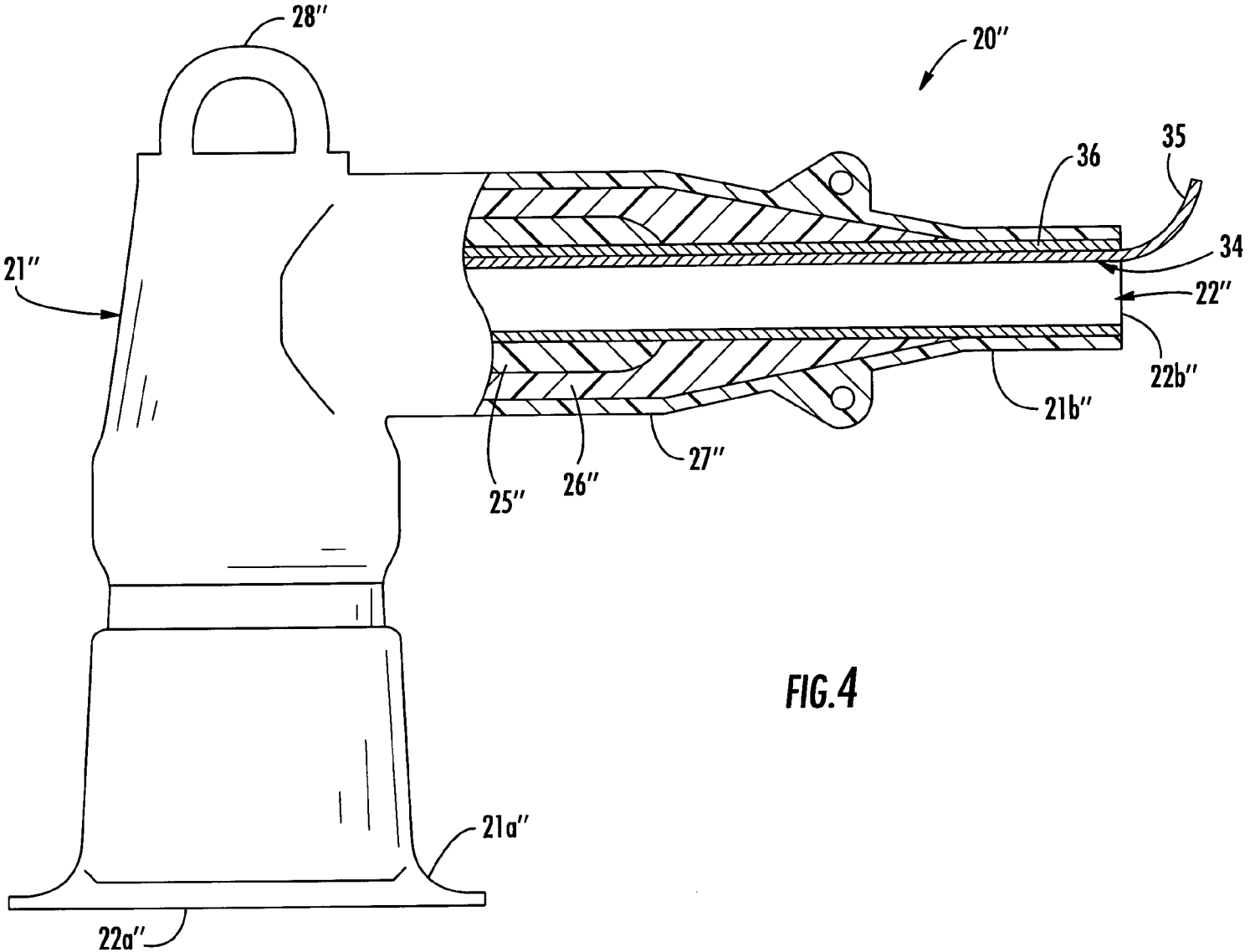
FIG. 4 is a fragmentary side elevational view of an elbow connector including a cold shrink core in accordance with the invention.

Turning now additionally to the illustrated elbow connector 20" shown in FIG. 4, another advantageous feature is now explained. As shown, a cold shrink core 34 is positioned within the second end 22*b*" of the passageway 22". Of course, in other embodiments, the cold shrink core 34 may be positioned within at least a portion of the passageway 22". The cold shrink core 34 illustratively comprises a carrier 36 and a release member 35 connected thereto so that the carrier maintains adjacent connector portions in an expanded state, such as to permit insertion of an electrical conductor, not shown. The release member 35 can then be activated, such as pulling, to remove the cold shrink core 34 so that the second connector end 21*b*" closes upon the electrical conductor.

The TPE materials facilitate molded-in cold shrink technology for separable elbow connectors 20", such as 200 and 600 Amp products, for example. Since the elbows 20" are typically mated onto 200 or 600 Amp bushing inserts, the bushing side or first end 21*a*" of the elbow need not be changed and a certain hardness/durometer and modulus can be maintained for the bushing side. But on the cable side or second end 21*b*" of the connector body 21" of the elbow connector 20", the TPE materials will allow use of cold shrink technology to initially expand the cable entrance.

Figure 5:
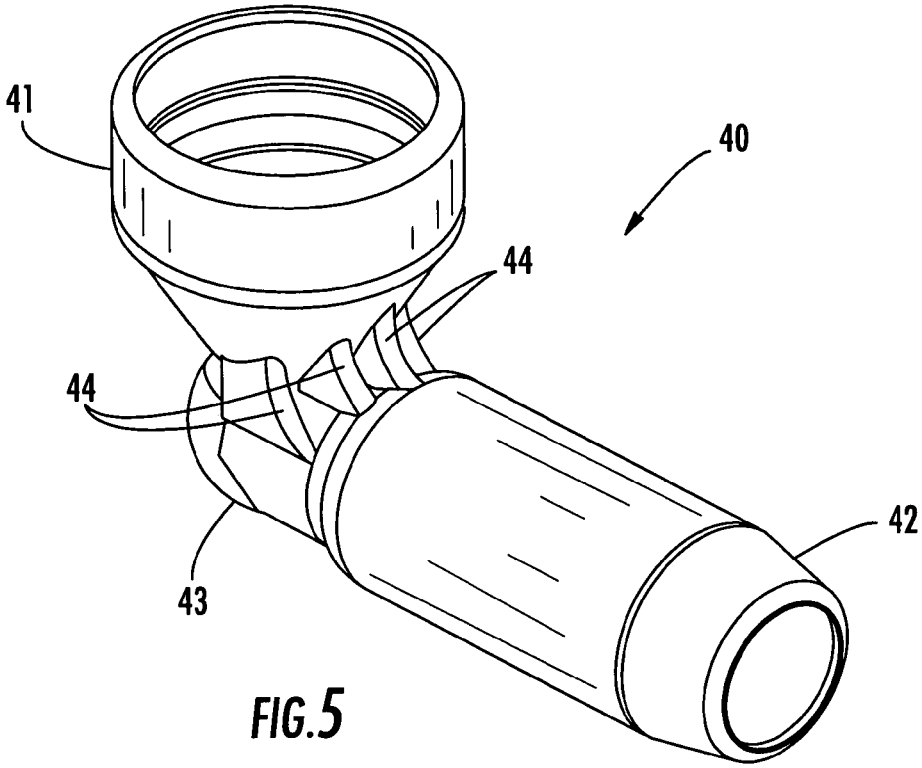
FIG. 5 is a perspective view of an embodiment of a first layer for an elbow connector of the invention.
Figure 6:
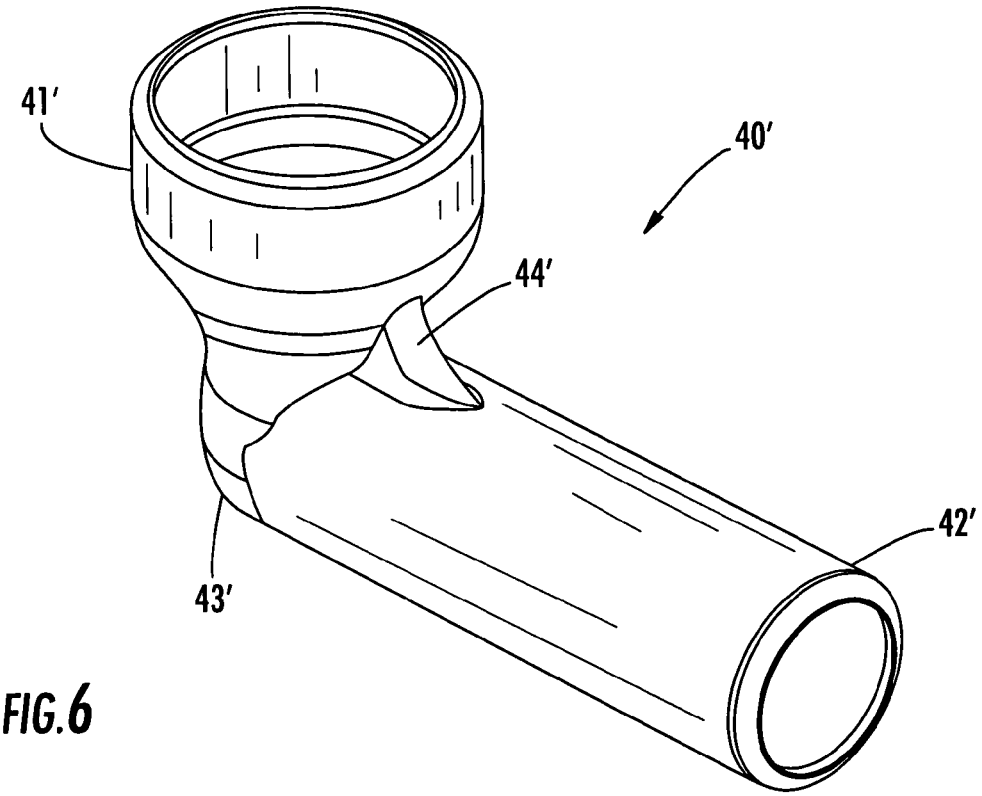
FIG. 6 is a perspective view of another embodiment of a first layer for an elbow connector of the invention.

Referring now again to FIGS. 1 and 2, and additionally to FIGS. 5 and 6, yet another aspect of the connectors relates to electrical stress that may be created at the first layer 25. As will be appreciated by those skilled in the art, the first layer 25 may have at least one predetermined property to reduce electrical stress. For example, the predetermined property may comprise a predetermined impedance profile. This impedance profile may be achieved during molding of the first layer 25 as facilitated by the use of a TPE material with additives or dopants, such as, zinc oxide, for example, that can tailor the impedance profile for electrical stress. Alternatively or additionally, the predetermined property may comprise a predetermined geometric configuration as will also be appreciated by those skilled in the art.

To address the electrical stress in those connector embodiments including at least one bend, the first layer 40 may be molded or otherwise shaped to have the appearance of the embodiment shown in FIG. 5. In particular, the first layer 40 illustratively includes first and second ends 41, 42 with a bend at the medial portion 43. To reduce electrical stress at the bend, a series of spaced apart ribs 44 are provided to extend between the adjacent connector portions at the right or inner angle of the bend. Of course, the first layer 40 may be provided by molding a semiconductive TPE material as described above, but in other embodiments, this first layer 40 may be formed from other materials having the desired mechanical and electrical properties.

A second embodiment of a first layer 40' is explained with particular reference to FIG. 6. In this embodiment, the first layer 40' includes slightly differently shaped first and second ends 41', 42'. In addition, only a single rib 44' is provided at the right angle portion of the bend to reduce electrical stress thereat. The configuration of the ribs 44 or single rib 44', as well as the configuration of the other connector body portions will be dependent on the desired operating voltage and current, as will be appreciated by those skilled in the art.

Of course, these stress control techniques can be used with any of the different electrical connector embodiments described herein. Typical 200 and 600 Amp elbow connectors, for example, may benefit from such stress control techniques as will be appreciated by those skilled in the art.

Referring now additionally to FIGS. 7–10 an anti-flashover feature of an elbow connector 50 is now described. A conventional elbow connector is subject to potential flashover as the connector is removed from the bushing insert and a partial vacuum is created as the end or cuff of the connector slides over the shoulder of the bushing insert. The prior art has attempted various approaches to address this partial vacuum/flashover shortcoming.

In accordance with the illustrated connectors 50, 50', this shortcoming is addressed by the connector body 51, 51' having an outer end portion 51*a*, 51*a*' adjacent the first end 52*a*, 52*a*' of the passageway 52, 52' with a flared shape, such as when abutting the shoulder 55, 55' of an electrical bushing insert 54, 54'. In other words, the outer end 53, 53' may abut the shoulder 55, 55' without the sliding contact that would otherwise cause the partial vacuum.

In the illustrated embodiment of FIG. 7, the outer end 53 of the connector body 51 may be initially formed to have the flared shape, even when separated from the shoulder 55 of the bushing insert 54, such as when initially manufactured. Of course, in other embodiments, the outer end 53 may be sized so that it is in spaced relation from the shoulder 55 even when fully seated, as an upper end of the bushing insert may engage and lock into a corresponding recess in the passageway 22 as will be appreciated by those skilled in the art.

As illustrated in the embodiment of FIGS. 8–10, the outer end 53' initially includes a slight radius of curvature (FIG. 8) so the outer end flares outwardly upon abutting the shoulder 55' (FIGS. 9 and 10). Of course, those of skill in the art will appreciate other similar configurations.

As also shown in the embodiment of the connector 50' of FIGS. 8–10, a series of longitudinally extending slits 56 may be provided to both facilitate the outward flaring and/or also provide at least a degree of air venting as the connector 50' is removed from the busing insert 54'. Accordingly, the likelihood of flashover is significantly reduced or eliminated. Moreover, for those embodiments using TPE materials, the outer end can be formed to be relatively thin to facilitate the flaring as described herein and as will be appreciated by those skilled in the art.

Another advantageous feature of the electrical connector 50' is now explained. As noted in the above background, in many instances it is desirable to visually indicate whether the connector is properly and fully seated onto the electrical bushing insert 54'. The illustrated embodiment of the connector 50' includes a colored band 57 serving as indicia to visually indicate to a technician that the connector has moved from the unseated position (FIG. 8) to the fully seated position (FIGS. 9 and 10). In other words, when the colored band 57 becomes fully visible to the technician viewing the connector 50' along an axis of the bushing insert 54' and first connector end 51*a*' (FIG. 10), the connector is fully seated. Conversely, in some embodiments, the outer end 53' could be configured so that, if viewed from the side, the colored band 57 would no longer be visible when properly seated. Those of skill in the art will appreciate other indicia configurations carried by the outer end of the connector 50' are also intended.

This indicator feature can be used, for example, for all elbows including 15, 25, 35 Kv 200 Amp devices, as well as many 600 Amp devices. Seating indicators exist in some prior art connectors, but these seating indicators are generally placed on the bushing insert. Accordingly, it may be difficult to see the indicator when the technician is positioning the elbow directly in front of the transformer. The seating indicators currently used typically employ a yellow band on the bushing that is covered up by the elbow cuff when the two portions are fully mated. After the products are mated together, the operator must view the side of the product to see if all of the yellow band is covered. In accordance with the indicator feature of the connector 50', the elbow cuff or outer end 53 will flip up or flare when fully mated so that it can be viewed when directly in front of the technician. Thus, the technician need not approach the energized equipment to view the fully latched connector.

Figure 11:
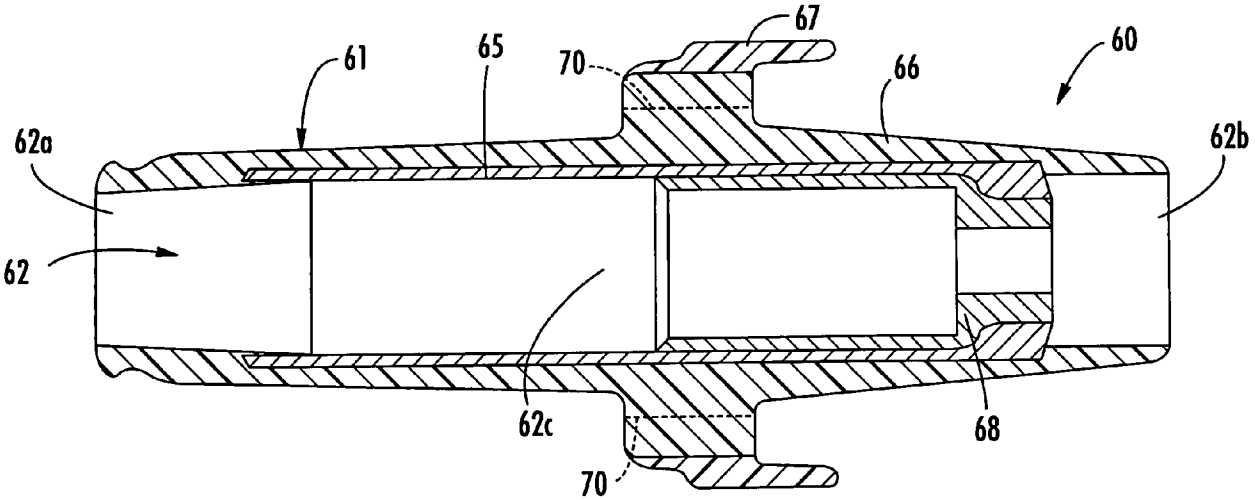
FIG. 11 is a longitudinal cross-sectional view of an embodiment of electrical bushing insert in accordance with the invention.
Figure 12:
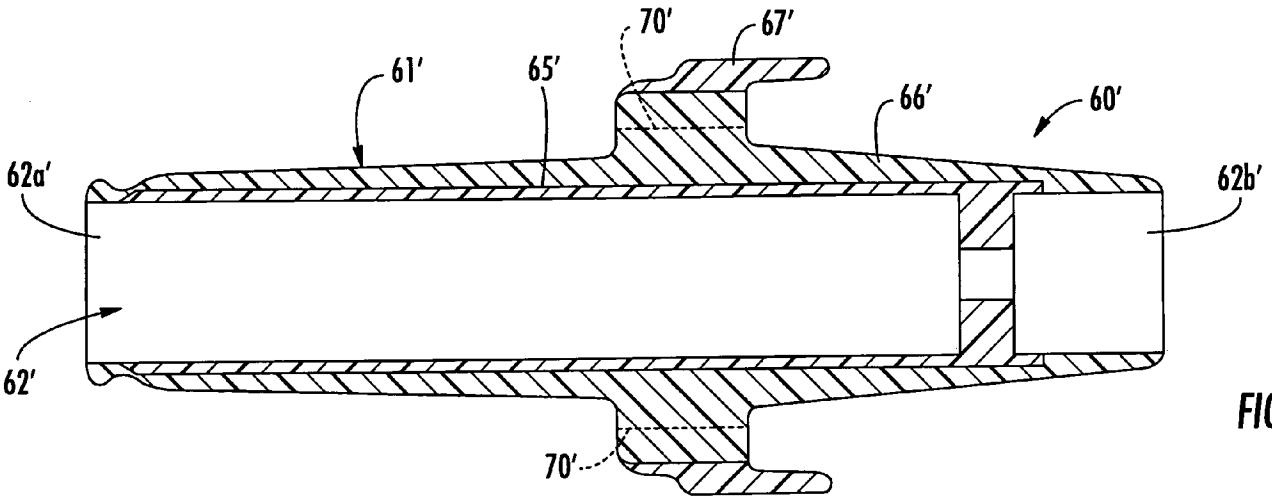
FIG. 12 is a longitudinal cross-sectional view of another embodiment of a bushing insert in accordance with the invention.
Figure 13:
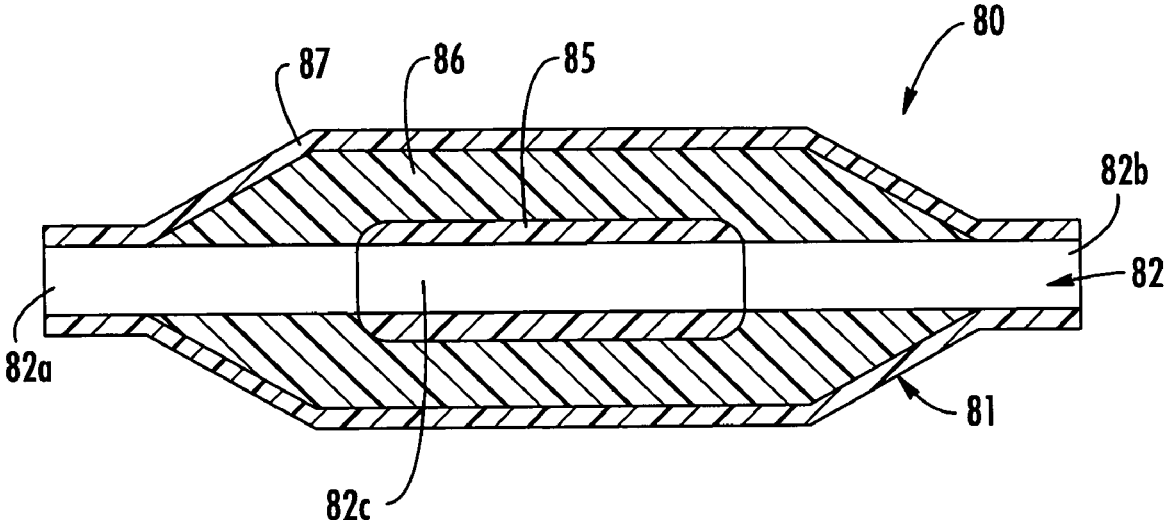
FIG. 13 is a longitudinal cross-sectional view of an electrical splice in accordance with the invention.

Referring now additionally to FIGS. 11–13 other types of connectors including the advantageous features described herein are now described. An electrical bushing insert 60 is shown in FIG. 11 and includes a connector body 61 having a tubular shape defining the passageway 62 having opposing ends 62*a*, 62*b* and a medial portion 62*c* therebetween. The connector body 61 illustratively includes a first layer 65 comprising metal, a second layer 66 comprising an insulative material and surrounding the first layer, and a third layer comprising, for example, a semiconductive material and surrounding the second layer at a medial portion of the connector body that is adjacent the medial portion of the passageway. Another metallic insert 68 is also provided in the illustrated embodiment within the passageway 62, although those of skill in the art will recognize that other materials and configurations for the conducting internal components of the bushing insert 60 are also possible.

The second and/or third layers 66, 67 may comprise TPE materials for the advantages as noted above. For example, the second layer 66 may comprise an insulative TPE material, and the third layer may comprise a semiconductive TPE material. As also shown in the illustrated embodiment, the second layer 66 may have an enlarged diameter adjacent the medial portion 62*c* of the passageway 62. Indeed this enlarged diameter medial portion may be formed by multiple layering of the insulative TPE material as indicated by the dashed lines 70', or by using other filler materials, for example, as will be appreciated by those skilled in the art. It may often be desirable to form successive relatively thin layers of the insulative TPE for the desired overall thickness and shape of the second layer 66. The first and third layers 65, 67, may also be formed of successive thinner layers in this connector embodiment, as well as the others described herein, and as will be appreciated by those skilled in the art.

A second embodiment of a bushing insert 60' is shown in FIG. 12 and now described in greater detail. In this embodiment, the first layer 65' is provided by a plastic material, such as a TPE material, for example. For example, the plastic material may be an insulative or semiconductive material. Those other elements of the bushing insert 60' are indicated by prime notation and are similar to those discussed above with reference to FIG. 11.

The rib feature described above to reduce electrical stress may also be applied to the embodiments of the bushing inserts 60, 60'. In addition, a plurality of bushing inserts 60, 60' may also be joined to a common bus bar, for example, to produce an electrical connector in the form typically called a junction as will be appreciated by those skilled in the art.

Referring now more particularly to FIG. 13, yet another electrical connector in the form of an inline splice 80 is now explained. The splice 80 illustratively includes a tubular connector body 81 defining a passageway 82 having first and second ends 82*a*, 82*b* with a medial portion 83*c* therebetween. The connector body 81 includes a first layer adjacent and/or defining the medial portion 82*c* of the passageway 82, a second layer 86 surrounding the first layer, and a third layer 87 surrounding the second layer. The first and/or third layers 65, 67 may comprise semiconductive TPE material, and the second layer 66 may comprise insulative TPE material. Accordingly, this splice 80 also enjoys the advantages and benefits provided by using TPE materials as described herein.

Figure 14:
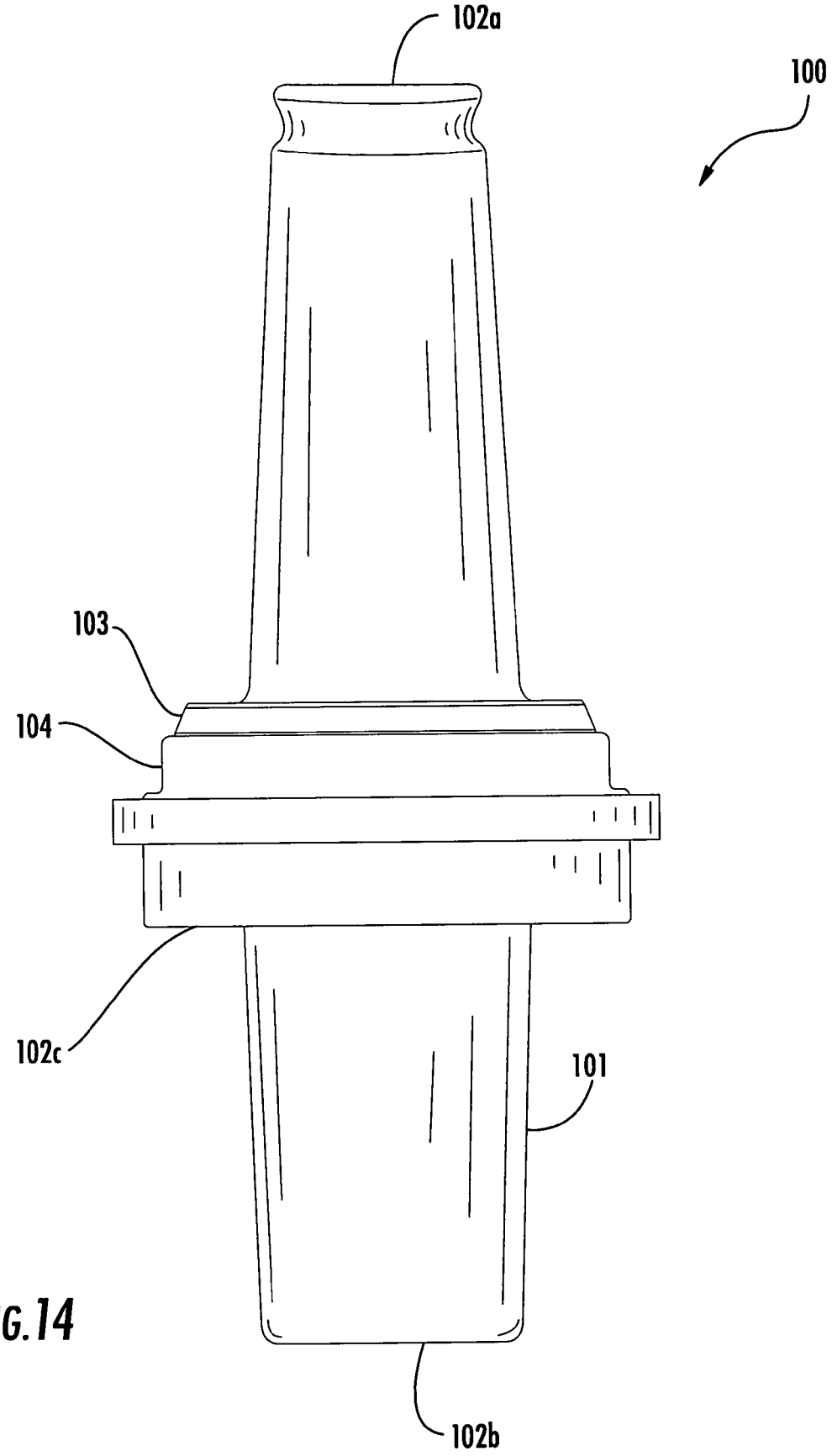
FIG. 14 is a side elevational view of another embodiment of an electrical bushing insert in accordance with the invention.

Turning now to FIG. 14 another embodiment of an electrical bushing insert 100 for avoiding flashover is now described. The insert 100 includes a connector body 101 having a tubular shape. The connector body 101 has opposing first and second ends 102*a*, 102*b* and a medial portion 102*c* therebetween. The various layers may include one or more TPE layers as described above with reference to FIGS. 11 and 12, or the layers could use conventional EPDM materials, or silicone materials, for example, as will be appreciated by those skilled in the art.

In this embodiment, the leading edge shoulder portion 103 is radially recessed or stepped inwardly from the adjacent medial shoulder portion 104. In addition, the leading edge shoulder portion 103 may include color indicia thereon, or include color pigments integrally molded therewith. Moreover, even the outer diameter of the medial shoulder portion 104 is sized to be less than the flared end of the connector to be seated thereon. For example, a typical flared connected end may have a diameter of 2.625". The outer diameter of the medial shoulder portion 104 may be made 2.600" so that a small gap exists between the opposing surfaces. Accordingly, a partial vacuum is avoided when separating the connectors so that the likelihood of flashover is avoided.

Figure 15:
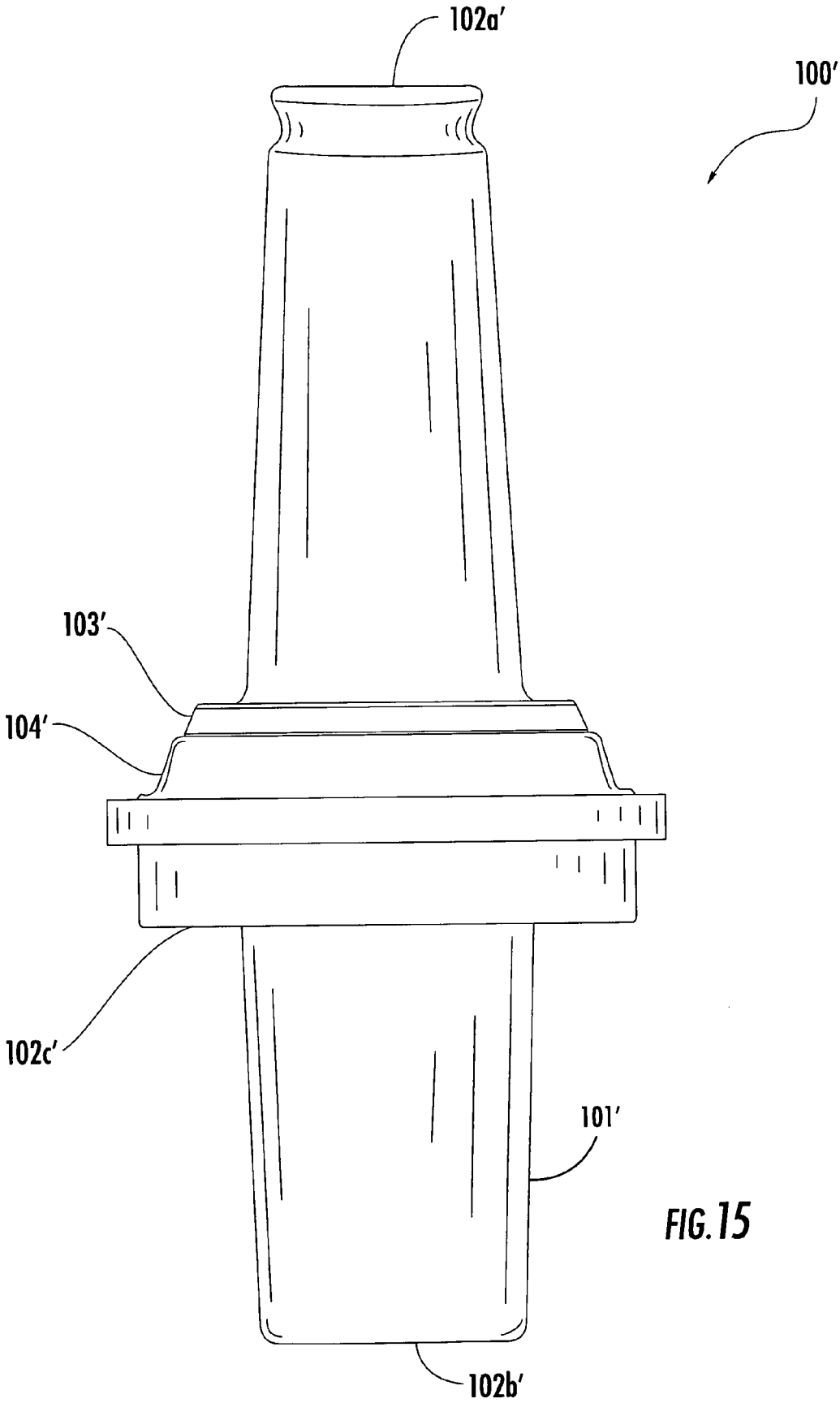
FIG. 15 is a side elevational view of still another embodiment of an electrical bushing insert in accordance with the invention.

Another variation of a flashover avoiding electrical bushing insert 100' is described with reference to FIG. 15. Like the embodiment described above, this bushing insert 100' includes a leading edge shoulder portion 103'; however, in this embodiment, the leading edge shoulder portion is stepped outwardly in diameter from the medial shoulder portion 104'. In this embodiment, the leading edge shoulder portion 103' is also smaller in diameter than the flared end of the connector to be received thereon. For example, the outer diameter of the leading edge shoulder portion 103' may be 2.600". Other dimensions are also possible so that the partial vacuum is not created upon separation of the connector.

Figure 16:
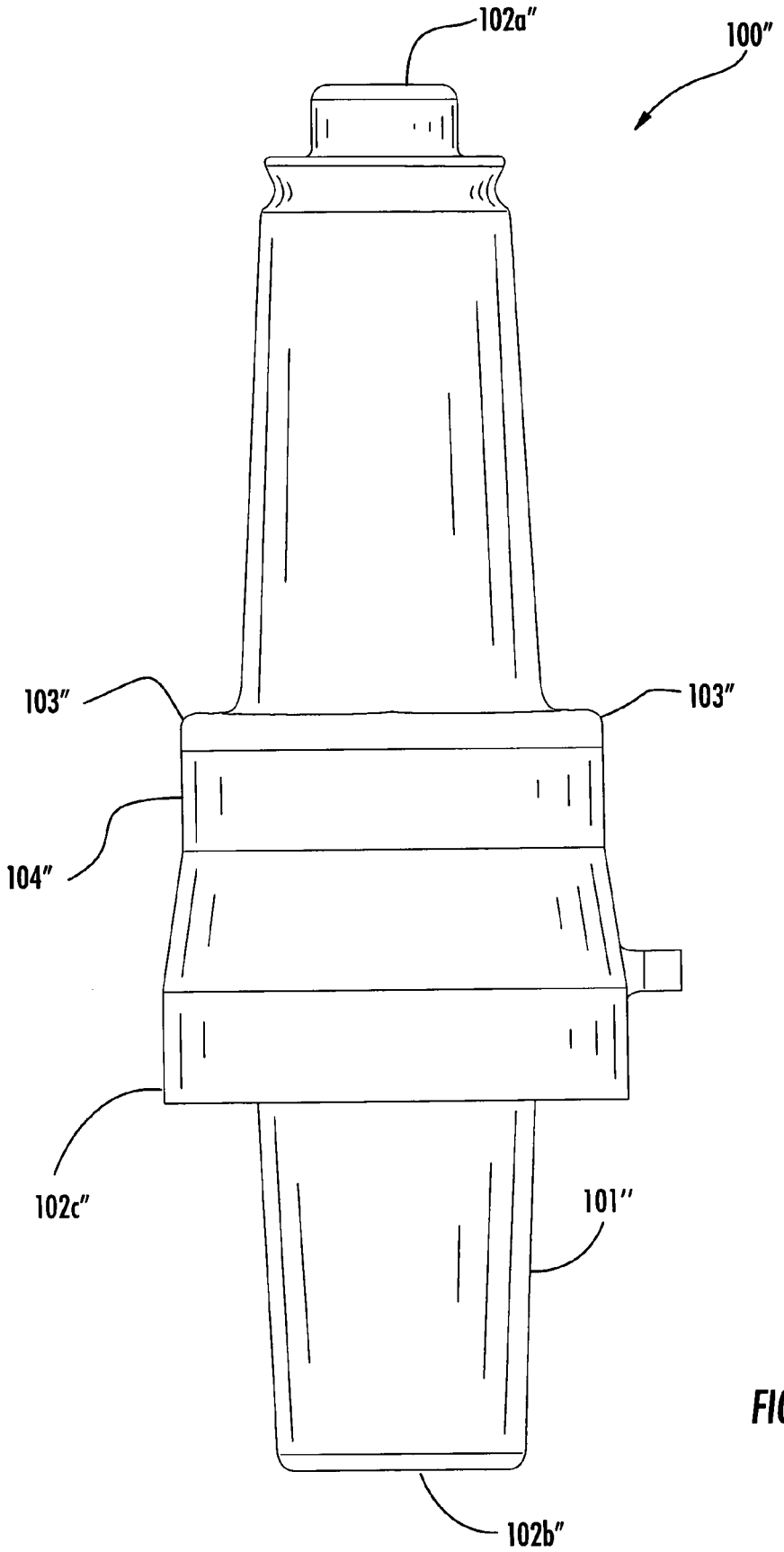
FIG. 16 is a side elevational view of yet another embodiment of an electrical bushing insert in accordance with the invention.

Referring now to FIG. 16, another variation of the leading edge shoulder portion 103" for the bushing insert 100" is now described. In this embodiment, the leading edge shoulder portion 103" is integrally molded of a different color than the adjacent medial shoulder portion 104". Also in this embodiment, the outer diameter of the leading edge shoulder portion and medial shoulder portion are both the same and less than the inner diameter of the flared end or cuff of the elbow connector as described in the paragraphs above.

Figure 17:
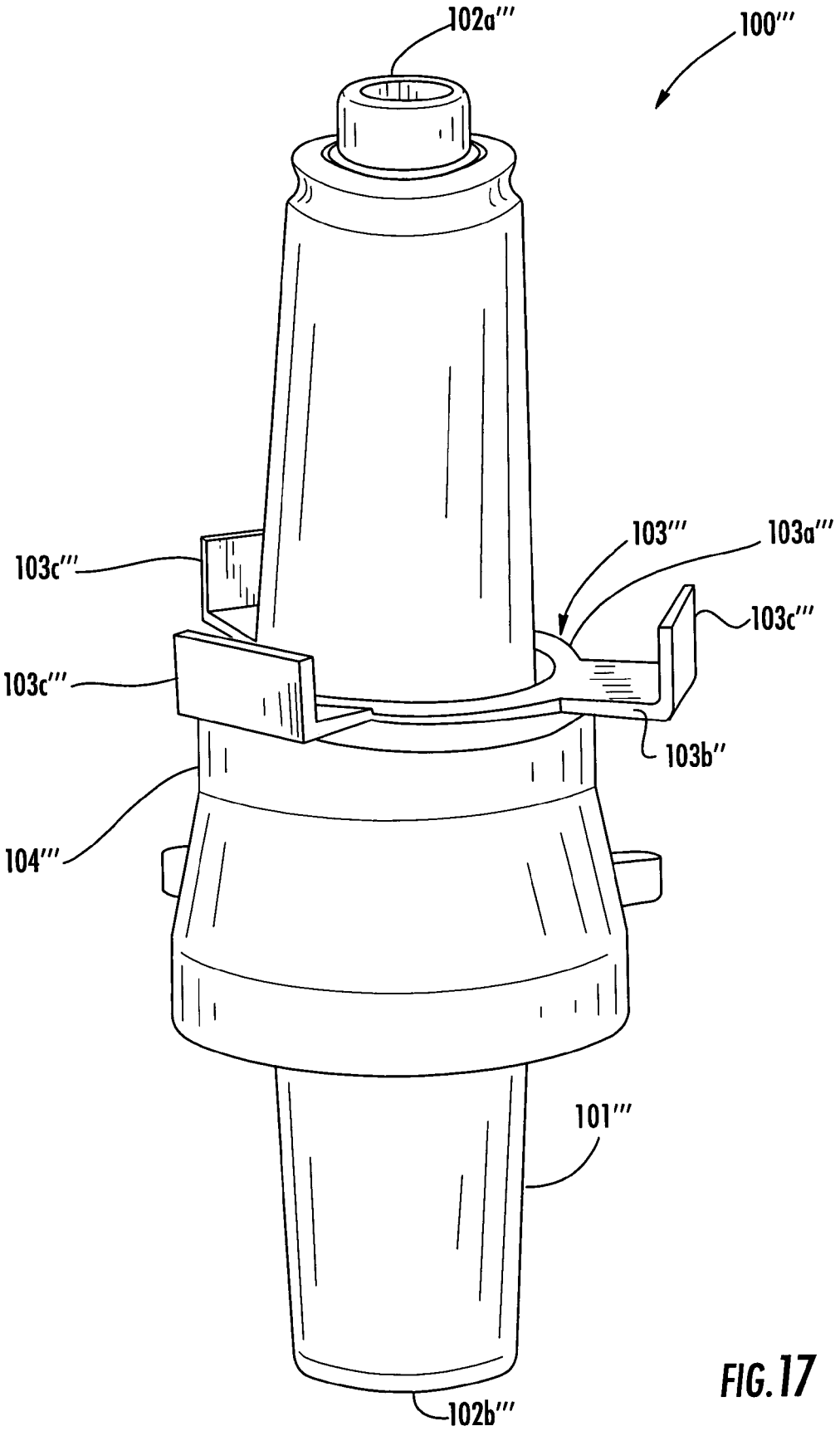
FIG. 17 is a side elevational view of a further embodiment of an electrical bushing insert in accordance with the invention.

Turning now to FIG. 17 another bushing insert 100''' is now described wherein the leading edge shoulder portion 105''' includes a series of spaced apart flexible flags extending outwardly from the inner body portion 103*a'''*. Each flag is defined by a radially outwardly extending portion 103*b'''* and a ninety-degree tip portion 103*c'''* carried at the end of the radially outwardly extending portion. When the elbow connector is positioned onto the bushing and properly seated, the ninety-degree tip portions 103*c'''* extend radially outwardly and indicate proper seating. Other indicating flag configurations are also contemplated by the invention.

Figure 18:
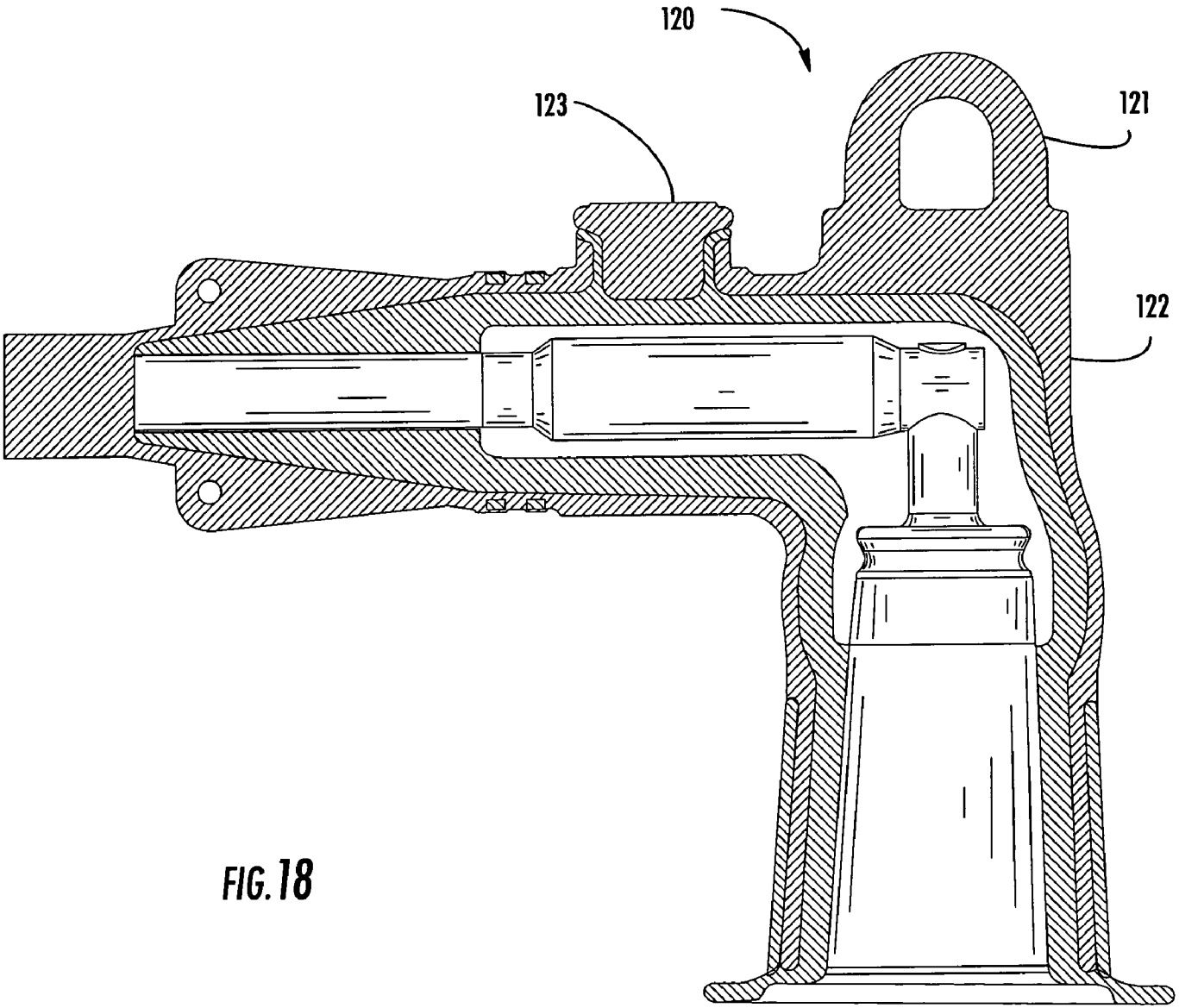
FIG. 18 is a cross-sectional view of an elbow connector in accordance with the present invention.

Turning now to FIG. 18, other features of an elbow connector 120 are now described. Conventional elbow connectors may use one or more members, such as metallic inserts, for the test point and/or pulling eye. For example, the metal may typically be aluminum for the test point, and stainless steel for the pulling eye. Such metal components typically require fairly aggressive adhesives to achieve a satisfactory bond with adjacent portions, and these adhesives may be considered environmentally unfriendly. In accordance with this aspect of the connector, the pulling eye 121 is provided by a conductive or nonconductive plastic body that forms an integral bond with the adjacent TPE layer portions 122. In other words, the pulling eye 121 is a member comprising a thermoplastic material different than the TPE and that forms a bond with adjacent TPE portions.

For example, the pulling eye 121 may be made of Virton polypropylene that forms a strong bond and may be able to withstand a pulling force of about 500 pounds. The test point may also include a similar conductive plastic insert 123 in place of aluminum which tends to form an oxide coating as will be appreciated by those skilled in the art. Other similar thermoplastic materials are also contemplated and avoid the need for the environmentally unfriendly adhesives typically required for metal bonding.

Figure 19:
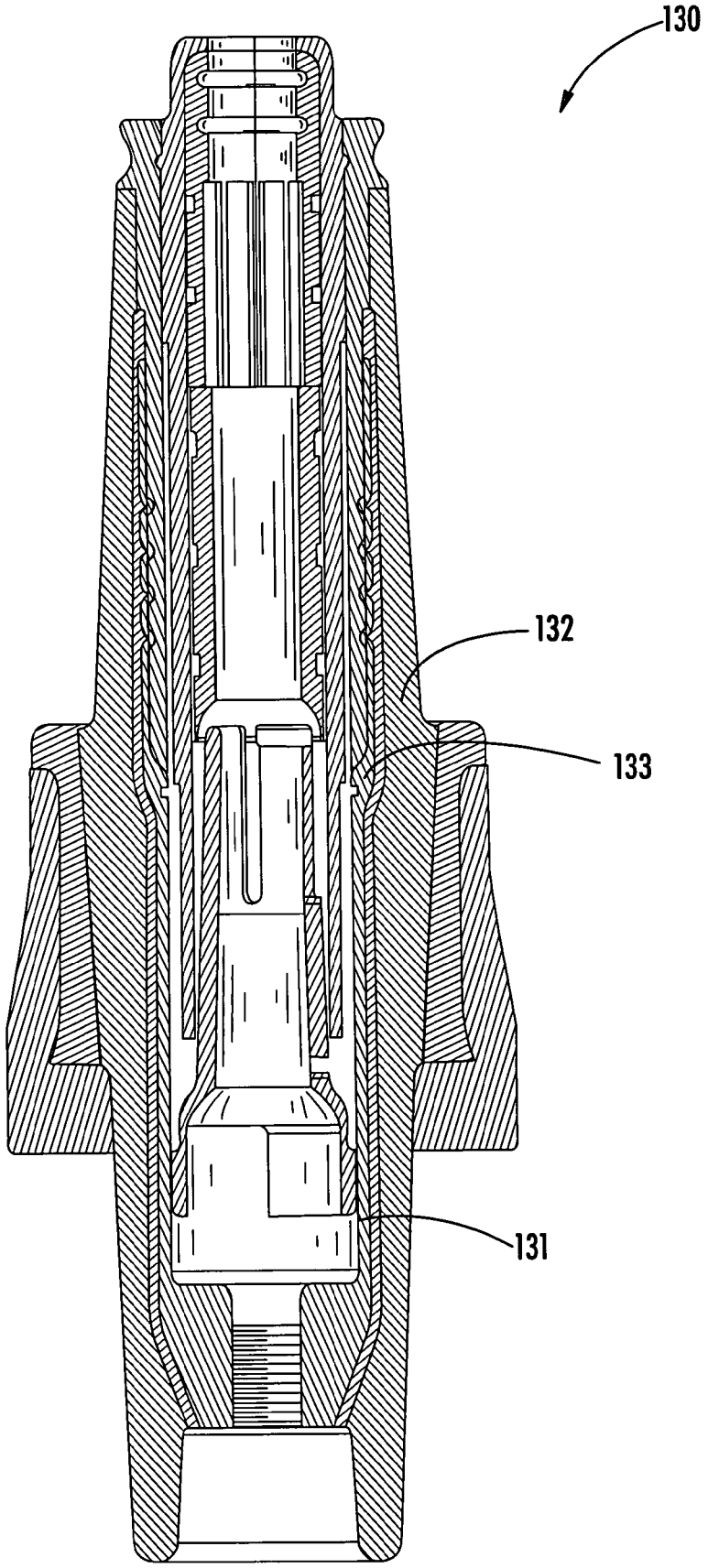
FIG. 19 is a cross-sectional view of another bushing in accordance with the invention.

Turning now to FIG. 19, another feature of the connector in the form of a bushing insert 130 is described. In a conventional bushing, an inner conductive container (usually of copper or aluminum) is surrounded by various thermosetting material layers, such as EPDM rubber. As described herein, thermoplastic elastomer (TPE) layers are used in place of the EPDM layers for the bushing. More particularly, the interface between the container 131 and the surrounding layer 132 is critical as any voids or irregularities can cause premature failure. Accordingly, a very aggressive adhesive is typically used, but unfortunately such an adhesive is environmentally unfriendly. As shown in the illustrated embodiment, a thin polypropylene layer 133 (e.g. 060 inch) is formed over the container 131 to act as a bonding layer between the container and the adjacent TPE layer 132 that is molded thereto as shown. The polypropylene layer may be conductive or nonconductive, and formed by injection molding or dipping, for example.

Another class of connectors 120 may include silicone as the material for the three layers rather than TPE. In this class of connectors, the thermoplastic material may comprise nylon, for example. The nylon will also form a strong bond with adjacent silicone portions as will be appreciated by those skilled in the art. Of course, other thermoplastics may be used with the silicone connector embodiments.

Many modifications and other embodiments of the invention will come to the mind of one skilled in the art having the benefit of the teachings presented in the foregoing descriptions and the associated drawings. Accordingly, it is understood that the invention is not to be limited to the illustrated embodiments disclosed, and that other modifications and embodiments are intended to be included.

That which is claimed is:

1. An electrical connector comprising:

a connector body having a passageway therethrough and comprising a first layer adjacent the passageway and having a relatively low resistivity, a second layer surrounding said first layer and comprising a material having a relatively high resistivity, and a third layer surrounding said second layer and comprising a material having the relatively low resistivity, at least one of said first, second and third layers comprising a thermoplastic elastomer (TPE) material, and at least one member comprising a different thermoplastic material than the TPE material and being bonded to adjacent portions of the TPE material.

2. An electrical connector according to claim 1 wherein the different thermoplastic material comprises polypropylene.

3. An electrical connector according to claim 1 wherein at least said third layer comprises the TPE material; and wherein said at least one member comprises a pulling eye insert embedded in said third layer.

4. An electrical connector according to claim 1 wherein at least said third layer comprises the TPE material; and wherein said at least one member comprises a test point insert embedded in said third layer.

5. An electrical connector according to claim 1 wherein at least said first layer comprises the TPE material; wherein said at least one member comprises a tubular thermoplastic layer within said first layer; and further comprising a tubular metal layer within said tubular thermoplastic layer and bonded thereto.

6. An electrical connector according to claim 1 wherein the passageway has first and second ends and a medial portion extending therebetween; and wherein said first layer is positioned along the medial portion of the passageway and is spaced inwardly from respective ends thereof.

7. An electrical connector according to claim 6 wherein the medial portion of the passageway has a bend therein.

8. An electrical connector according to claim 6 wherein said connector body has a tubular shape defining the passageway.

9. An electrical connector according to claim 1 wherein said connector body is configured for at least one of 15 KV and 200 Amp operation.

10. An electrical connector according to claim 1 wherein each of said first and third layers has a resistivity less than about $10^8$ Ω·cm; and wherein said second layer has a resistivity greater than about $10^8$ Ω·cm.

11. An electrical connector comprising:

a connector body having a passageway therethrough and comprising a first layer adjacent the passageway and having a relatively low resistivity, a second layer surrounding said first layer and comprising a material having a relatively high resistivity, and a third layer surrounding said second layer and comprising a material having the relatively low resistivity, at least one of said first, second and third layers comprising a silicone material, and at least one member comprising a thermoplastic material bonded to adjacent silicone material portions.

12. An electrical connector according to claim 11 wherein the thermoplastic material comprises nylon.

13. An electrical connector according to claim 11 wherein at least said third layer comprises the silicone material; and wherein said at least one member comprises a pulling eye insert embedded in said third layer.

14. An electrical connector according to claim 11 wherein at least said third layer comprises the silicone material; and wherein said at least one member comprises a test point insert embedded in said third layer.

15. An electrical connector according to claim 11 wherein at least said first layer comprises the silicone material; wherein said at least one member comprises a tubular thermoplastic layer within said first layer; and further comprising a tubular metal layer within said tubular thermoplastic layer and bonded thereto.

16. An electrical connector according to claim 11 wherein the passageway has first and second ends and a medial portion extending therebetween; and wherein said first layer is positioned along the medial portion of the passageway and is spaced inwardly from respective ends thereof.

17. An electrical connector according to claim 16 wherein the medial portion of the passageway has a bend therein.

18. An electrical connector according to claim 16 wherein said connector body has a tubular shape defining the passageway.

19. An electrical connector according to claim 11 wherein said connector body is configured for at least one of 15 KV and 200 Amp operation.

20. An electrical connector according to claim 11 wherein each of said first and third layers has a resistivity less than about $10^8$ Ω·cm; and wherein said second layer has a resistivity greater than about $10^8$ Ω·cm.

21. A method for making an electrical connector comprising a connector body having a passageway therethrough and including a first layer adjacent the passageway and having a relatively low resistivity, a second layer surrounding the first layer and comprising a material having a relatively high resistivity, and a third layer surrounding the second layer and comprising a material having the relatively low resistivity, the method comprising:

forming at least one of the first, second and third layers to comprise a thermoplastic elastomer (TPE) material; and bonding at least one member comprising a different thermoplastic material than the TPE material to adjacent portions of the TPE material.

22. A method according to claim 21 wherein the different thermoplastic material comprises polypropylene.

23. A method according to claim 21 wherein at least the third layer comprises the TPE material; and wherein the at least one member comprises a pulling eye insert embedded in the third layer.

24. A method according to claim 21 wherein at least the third layer comprises the TPE material; and wherein the at least one member comprises a test point insert embedded in the third layer.

25. A method according to claim 21 wherein at least the first layer comprises the TPE material; wherein the at least one member comprises a tubular thermoplastic layer within the first layer; and further comprising bonding a tubular metal layer within the tubular thermoplastic layer.

26. A method according to claim 21 wherein the passageway has first and second ends and a medial portion extending therebetween; and wherein the first layer is positioned along the medial portion of the passageway and is spaced inwardly from respective ends thereof.

27. A method according to claim 26 wherein the medial portion of the passageway has a bend therein.

28. A method according to claim 26 wherein the connector body has a tubular shape defining the passageway.

29. A method according to claim 21 wherein the connector body is configured for at least one of 15 KV and 200 Amp operation.

30. A method according to claim 21 wherein each of the first and third layers has a resistivity less than about $10^8$ Ω·cm; and wherein the second layer has a resistivity greater than about $10^8$ Ω·cm.

31. A method for making an electrical connector comprising a connector body having a passageway therethrough and including a first layer adjacent the passageway and having a relatively low resistivity, a second layer surrounding the first layer and comprising a material having a relatively high resistivity, and a third layer surrounding the second layer and comprising a material having the relatively low resistivity, the method comprising:

forming at least one of the first, second and third layers to comprise a silicone material; and bonding at least one member comprising a thermoplastic material to adjacent portions of the silicone material.

32. A method according to claim 31 wherein the thermoplastic material comprises nylon.

33. A method according to claim 31 wherein at least the third layer comprises the silicone material; and wherein the at least one member comprises a pulling eye insert embedded in the third layer.

34. A method according to claim 31 wherein at least the third layer comprises the silicone material; and wherein the at least one member comprises a test point insert embedded in the third layer.

35. A method according to claim 31 wherein at least the first layer comprises the silicone material; wherein the at least one member comprises a tubular thermoplastic layer within the first layer; and further comprising bonding a tubular metal layer within the tubular thermoplastic layer.

36. A method according to claim 31 wherein the passageway has first and second ends and a medial portion extending therebetween; and wherein the first layer is positioned along the medial portion of the passageway and is spaced inwardly from respective ends thereof.

37. A method according to claim 36 wherein the medial portion of the passageway has a bend therein.

38. A method according to claim 36 wherein the connector body has a tubular shape defining the passageway.

39. A method according to claim 31 wherein the connector body is configured for at least one of 15 KV and 200 Amp operation.

40. A method according to claim 31 wherein each of the first and third layers has a resistivity less than about $10^8$ Ω·cm; and wherein the second layer has a resistivity greater than about $10^8$ Ω·cm.

* * * * *

UNITED STATES PATENT AND TRADEMARK OFFICE

CERTIFICATE OF CORRECTION

PATENT NO. : 7,104,823 B2
APPLICATION NO. : 11/198948
DATED : September 12, 2006
INVENTOR(S) : Jazowski et al.

It is certified that error appears in the above-identified patent and that said Letters Patent is hereby corrected as shown below:

Column 3, Line 34

Delete: "busing"

Insert: -- bushing --

Column 9, Line 7

Delete: "busing"

Insert: -- bushing --

Signed and Sealed this

Tenth Day of April, 2007

JON W. DUDAS
*Director of the United States Patent and Trademark Office*